US012680038B2

(12) United States Patent
Chataing et al.

(10) Patent No.: US 12,680,038 B2
(45) Date of Patent: Jul. 14, 2026

(54) METHOD FOR GASIFYING BIOMASS

(71) Applicant: COMMISSARIAT À L'ÉNERGIE ATOMIQUE ET AUX ÉNERGIES ALTERNATIVES, Paris (FR)

(72) Inventors: Thierry Chataing, Grenoble (FR); Gilles Ratel, Grenoble (FR); Thomas Robin, Toulon (FR)

(73) Assignee: COMMISSARIAT À L'ÉNERGIE ATOMIQUE ET AUX ÉNERGIES ALTERNATIVES, Paris (FR)

( * ) Notice: Subject to any disclaimer, the term of this patent is extended or adjusted under 35 U.S.C. 154(b) by 651 days.

(21) Appl. No.: 18/154,146

(22) Filed: Jan. 13, 2023

(65) Prior Publication Data

US 2023/0313058 A1 Oct. 5, 2023

(30) Foreign Application Priority Data

Jan. 14, 2022 (FR) ..... 2200302

(51) Int. Cl.
*C10J 3/12* (2006.01)

(52) U.S. Cl.
CPC ..... *C10J 3/12* (2013.01); *C10J 2200/09* (2013.01); *C10J 2200/158* (2013.01); *C10J 2200/36* (2013.01); *C10J 2300/092* (2013.01); *C10J 2300/0923* (2013.01)

(58) Field of Classification Search
None
See application file for complete search history.

(56) References Cited

U.S. PATENT DOCUMENTS

2010/0154305 A1 6/2010 Elliott
2013/0017460 A1* 1/2013 Keefer ..... C10B 57/06 585/242
2014/0054507 A1 2/2014 Elliott
2017/0066981 A1 3/2017 Wada
2017/0218286 A1 8/2017 Harinck
2018/0009692 A1 1/2018 Favarat

FOREIGN PATENT DOCUMENTS

FR 2882046 A1 8/2006
WO 2016/113685 A1 7/2016

* cited by examiner

*Primary Examiner* — Daniel Berns
(74) *Attorney, Agent, or Firm* — Chrisman Gallo Tochtrop LLC

(57) ABSTRACT

Gasification method comprising the following steps of: a) bringing, in a main reactor, beads made of steel, an alloy, glass or ceramic, at a temperature between 600° C. and 1,000° C., into contact with a feedstock mixture comprising water and a biomass, the biomass comprising an organic part and salts, the main reactor being pressurised to more than 224 bar and at a temperature above 200° C. b) gasifying the organic part in the presence of the beads, thereby forming a gaseous phase, an aqueous phase and a solid residue, and whereby the salts precipitate on the beads, forming a salt shell covering the beads, c) separating the beads from the organic part, d) regenerating the beads.

15 Claims, 2 Drawing Sheets

METHOD FOR GASIFYING BIOMASS

TECHNICAL FIELD

The present invention relates to the general field of converting biomass into energy.

The invention relates to a method for gasifying biomass.

The invention further relates to a gasification device.

The invention is of particular interest as it allows the salts to be easily separated from the carbonaceous matter of the biomass, thus increasing the gasification efficiency.

The invention has applications in many industrial fields, in particular for the recovery of waste from the paper industry such as black liquor, but also for the recovery of sludge from wastewater treatment plants.

PRIOR ART

Currently, in a context of an increasing scarcity of fossil resources and worsening global warming, alternatives to oil must be found. In particular, research has focused on converting bio-resources into energy and in particular on recovering household or industrial waste such as black liquor originating from the preparation of papermaking pulp.

Most thermochemical biomass recovery methods comprise a step of gasifying the biomass in supercritical water. This method represents one recovery route that is well suited to wet resources.

This method consists of gasifying the biomass in the presence of water in a supercritical state (typically at temperatures from 500° C. to 600° C.) to obtain a syngas composed essentially of carbon monoxide (CO), dihydrogen ($H_2$) and carbon dioxide ($CO_2$). The CO and $H_2$ can then be used to obtain $CH_2$ hydrocarbon chains similar to those from hydrocarbons of fossil origin and thus produce a synthetic fuel. The carbon is thus recovered in the form of methane or syngas to produce fuels.

The gasification step can be preceded by a pyrolysis step.

However, this supercritical water method encounters problems involving fouling caused by the (inorganic) salts and the minerals contained in the resource which directly impact the efficiency of the method.

The hydrothermal biomass gasification method can be carried out at a lower temperature (between 374° C. and 500° C.) in the presence of a catalyst such as ruthenium as a catalyst [1]. However, such catalysts are sensitive to pollutants, and in particular sulphur, and deactivate easily under supercritical conditions. Sulphur compounds can also produce hydrogen sulphide $H_2S$. They are thus separated before the gasification step, using an absorbent bed (metal or metal oxide) to form insoluble sulphides. The biomass is also pre-treated with a heat treatment at least 300° C. During the method, the salts precipitate and can be collected. Through the use of ruthenium, methane is predominantly produced.

Sulphate ions can also be separated by adding cations, for example calcium cations or barium cations [2].

The salts can also be separated by precipitation under supercritical conditions [3]. The separator contains a fluidised bed which can comprise grains of sand or glass, ceramic or metal beads. The size of these elements is chosen such that they do not pass through the grids. Heat exchangers integrated into the salt separator are also used. The salts are separated from the supercritical fluid, for example, with a hydrocyclone-type device. Although the heat exchange system using tubes is efficient, such a system is bulky.

Another document describes a system for collecting salts in a fluidised bed with particles [4]. Hydrothermal gasification takes place in a tube. This bed is composed of one or more components such as sand, aggregates of mineral origin (crushed stone), or stainless steel, glass or ceramic particles for example. The particles range in size from 20 μm to 1 mm. These components are introduced either at the same time as the biomass or prior to the introduction of the biomass. The salts present in the biomass can solidify and then form part of the bed of particles.

However, such a solution cannot be used with a viscous matter such as concentrated black liquor as the system could quickly become clogged. Furthermore, such a system cannot operate continuously as it has to be stopped to collect the salt-containing particles.

DESCRIPTION OF THE INVENTION

One purpose of the present invention is to propose a gasification method that overcomes the drawbacks of the prior art, and in particular a method that allows the inorganic salts initially present in the biomass to be easily collected.

For this purpose, the present invention proposes a method for gasifying biomass comprising the following steps of:

a) bringing, in a main reactor, beads heated to a temperature between 600° C. and 1,000° C., and preferably between 900° C. and 1,000° C., into contact with a feedstock mixture comprising water and a biomass, the biomass comprising an organic part and salts, the beads being made of a material that is selected from steel, a metal alloy, glass or a ceramic, and preferably having a diameter of between 500 μm and 2 mm, preferably between 700 μm and 1 mm, the main reactor is pressurised to more than 222 bar, for example to more than 250 bar, and preferably heated to a temperature above 200° C. and below 374° C., for example between 200° C. and 300° C., b) at least partially gasifying the organic matter, in the presence of the beads at a temperature above 374° C. and at a pressure above 222 bar, preferably at a temperature between 400° C. and 500° C. and at a pressure above 250 bar (for example at a temperature of 450° C. and at a pressure of 300 bar), thereby forming a gaseous phase, an aqueous phase and a solid residue, and whereby the salts precipitate on the beads, forming a salt shell covering the beads, The Method Further Comprises the Following Steps of:

c) separating the beads covered by the salt shell from the organic part, d) regenerating the beads, for example, by the following sub-steps:

d1) dissolving the salt shell of the beads, for example by washing the beads with an aqueous solution at a temperature below 374° C., whereby the salts are dissolved, d2) heating the beads to a temperature between 600° C. and 1,000° C. and preferably between 900° C. and 1,000° C., which also allows any possible traces of carbon to be removed, step d2) preferably being carried out by combustion in the presence of dioxygen.

The invention differs fundamentally from the prior art in that a feedstock stream containing the biomass and water is brought into contact with beads heated to very high temperatures (between 600° C. and 1,000° C., or even between 900° C. and 1,000° C.) in a reactor pressurised to over 222 bar. When the feedstock mixture comes into contact with the hot beads, a significant heat exchange takes place: the beads provide enough energy to increase the temperature of the reaction mixture in situ and for the conditions in the main reactor to become supercritical (i.e. a temperature above 374° C. and a pressure above 222 bar). The water contained in the stream of matter is thus under supercritical conditions. The salts contained in the biomass precipitate on the beads, forming a shell around them. The salts are thus trapped on the beads and separated from the carbonaceous matter of the biomass.

Advantageously, the feedstock mixture is preheated to a temperature from 150° C. to 300° C., before step a).

Advantageously, the method comprises a step in which ethanol is injected into the main reactor to dissolve the oils contained in the biomass or resulting from step a). Ethanol can be injected into the main reactor simultaneously with the stream of matter or after step a).

Advantageously, the beads fall into the main reactor under gravity.

In step b), the recoverable organic part is gasified. In step b), the organic part can be gasified in the main reactor or preferably in a gasification reactor (also referred to as a supercritical water (SCW) reactor).

The gasification takes place at a temperature preferably below 600° C. and preferably below 500° C.

Step b) results in a partial gasification of the biomass. At the end of the method, the biomass gasification process can be completed.

Advantageously, the method further comprises a subsequent step e) in which a further gasification step is carried out at a pressure above 222 bar and preferably above 250 bar in order to completely gasify the organic matter (i.e. to gasify the organic matter not gasified in step b)). According to a first alternative embodiment, the temperature in step e) is between 600 and 700° C. This embodiment is advantageous in cases where the biomass contains sulphur. According to another alternative embodiment, step e) is carried out in the presence of a catalyst at a low temperature (i.e. at a temperature below 500° C.): this is a catalytic gasification reaction.

According to an advantageous alternative embodiment, sub-steps d1) and d2) are carried out in the main reactor. The beads are, for example, washed in the main reactor so that they can be directly reused for a new cycle.

In a highly advantageous alternative embodiment, the main reactor or the gasification reactor is in fluid communication with a collection chamber and the beads are collected in the collection chamber, for example under gravity, in step c).

Advantageously, sub-step d1) is carried out in the collection chamber.

Advantageously, sub-step d2) is carried out by means of a heating reactor or by means of a plurality of heating reactors positioned in series, the one or more reactors being positioned between the collection chamber and the main reactor. For example, a preheating reactor and a heating reactor placed in series are used.

Advantageously, during sub-step d1), the beads are washed, preferably with the aqueous phase from step b), which is optionally diluted. This is used to dissolve the salts on the beads and thus clean the beads. The liquid thus obtained is discharged with the salts. These salts can ideally be reused by the paper industry or by other industries for example. Optionally, water can be added for this regeneration step in order to be able to completely collect the salts.

Advantageously, energy can be provided by the solid residue or char produced during hydrothermal gasification and/or by other carbonaceous bioresources. For this purpose, a step of combusting the char deposited on beads can take place by injecting oxygen, advantageously in the preheating reactor.

Advantageously, the solid residue from step b) is used to help heat the beads to a temperature between 600° C. and 1,000° C. and preferably between 900° C. and 1,000° C. in sub-step d2).

The Method has Numerous Advantages:

- closed cycle operation limiting high-pressure and high-temperature sealing problems,
- implementation of proven technological solutions,
- ability to trap and collect salts continuously by the continuous cleaning of the beads,
- heat exchanges improved by direct contact between the beads and the supercritical water,
- ability to recycle the used beads,
- recovery of the carbon trapped by combustion,
- recycling of the aqueous phase to wash the beads,
- conversion of the char produced and trapped during the reaction into energy by combustion (as a heat input for the method),
- recycling of the aqueous phase to wash the beads,
- some non-recoverable gases can be used to operate a turbine for example,
- prevention of device clogging and ability to treat viscous matters,
- no need to carry out pyrolysis beforehand: all conversion steps take place under hydrothermal conditions,
- the gasification stage takes place at a high temperature (around 600° C.) either without a catalyst or with a catalyst, The invention further relates to a gasification device.

The Gasification Device Comprises:

- a main reactor, preferably configured to be pressurised to more than 222 bar, for example to more than 250 bar, and preferably heated to a temperature above 200° C., for example between 200° C. and 300° C., the main reactor comprising a feedstock mixture inlet, a bead inlet and an outlet for discharging a solution comprising the beads and the feedstock mixture,
- a gasification reactor capable of being heated to a temperature above 374° C., preferably between 400° C. and 600° C., even more preferably between 400° C. and 500° C., and subjected to a pressure above 222 bar, preferably above 250 bar, the gasification reactor being connected to the outlet of the main reactor, the gasification reactor being provided with an outlet,
- beads made of a material that is selected from steel, a metal alloy, glass or a ceramic, the beads preferably having a diameter in the range 500 μm to 2 mm, preferably in the range 700 μm to 1 mm,
- a bead collection chamber connected to the outlet of the gasification reactor and provided with an outlet for discharging a mixture comprising a gaseous phase and an aqueous phase and an outlet for discharging the beads,
- a circulation system for circulating the beads through the main reactor, through the gasification reactor and then the collection chamber.

Advantageously, the device further comprises one or more heating reactors (for example a preheating reactor and a heating reactor) placed in series, the one or more heating reactors being positioned between the collection chamber and the main reactor, the heating reactor being configured to heat the beads prior to injecting them into the main reactor via the bead inlet. The heating reactor allows the beads to be regenerated before being reused. The beads can thus circulate continuously and cyclically in the aforementioned elements (main reactor, gasification reactor, collection chamber, heating reactor).

This device is of particular interest as it allows the salts to be trapped and easily collected.

The device does not comprise a fluidised bed.

The heat exchange system is very efficient. The energy input is made more efficient by the direct, in situ input of heat inside the reactor.

Other features and advantages of the invention will appear upon reading the additional description given hereinbelow.

It goes without saying that this additional description is provided solely for the purpose of illustrating the object of the invention and must not be interpreted as constituting a limitation thereto in any way.

BRIEF DESCRIPTION OF THE DRAWINGS

The present invention will be better understood after reading the following description of example embodiments, given for purposes of illustration only and not intended to limit the scope of the invention, with reference to the accompanying drawings, in which.

The different parts shown in the figures are not necessarily displayed according to a uniform scale in order to make the figures easier to read.

The different possibilities (alternatives and embodiments) must be understood as not being mutually exclusive and can be combined with one another.

Moreover, in the description below, the terms that depend on the orientation, such as "above", "below", etc. of a structure apply for a structure that is considered to be oriented in the manner illustrated in the figures.

DETAILED DESCRIPTION OF SPECIFIC EMBODIMENTS

Figure 1:
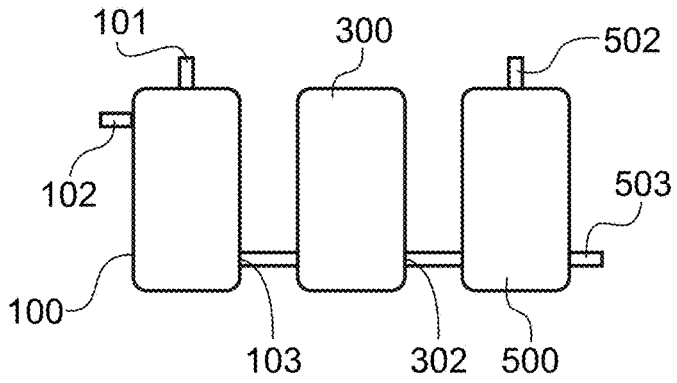
FIG. 1 diagrammatically shows a sectional view of a device for gasifying a biomass that allows the salts to be separated from the organic part of the biomass according to one specific embodiment of the invention.
Figure 2:
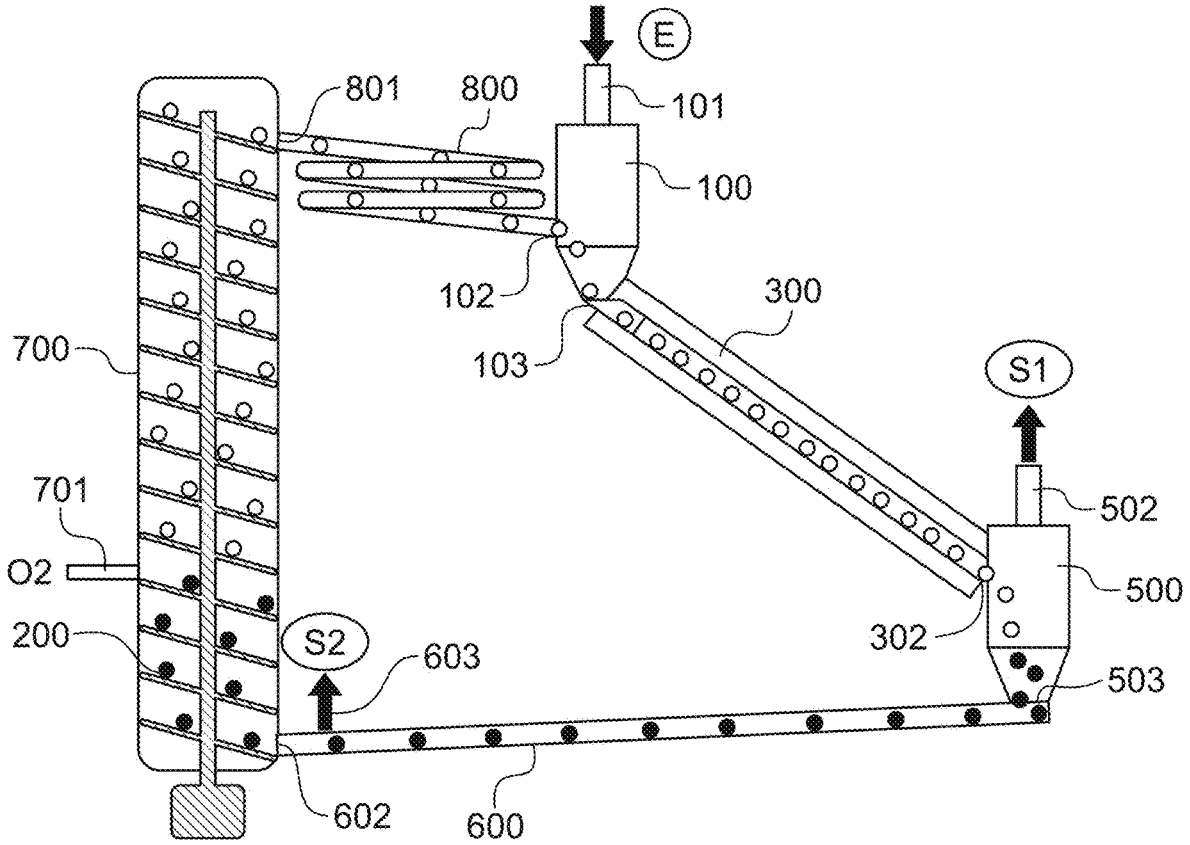
FIG. 2 diagrammatically shows a device for gasifying a biomass that allows the salts to be separated from the organic part of the biomass according to another specific embodiment of the invention.

The method for gasifying biomass will now be described in more detail. In particular, a gasification method operating in a closed loop will be described in more detail. The method comprises the following cycle of steps (FIGS. 1 and 2):

carrying out, one or more times, a cycle comprising the following steps of:

a) pressurising and heating the main reactor 100 to above 222 bar, in particular to above 250 bar and to a temperature above 200° C., for example to a temperature between 200° C. and 300° C., then bringing, in the main reactor 100, the beads 200 heated to a temperature between 600° C. and 1,000° C., and preferably between 900° C. and 1,000° C., into contact with a feedstock mixture comprising water and a biomass, the biomass comprising an organic part and salts, the beads being made of a material that is selected from steel, a metal alloy, glass or a ceramic, and preferably having a diameter of between 500 μm and 2 mm, b) carrying out a first gasification (partial gasification) of the organic matter at a temperature above 374° C. and at a pressure above 222 bar, preferably at a temperature between 400° C. and 500° C. and at a pressure above 250 bar (for example at a temperature of 450° C. and at a pressure of 300 bar), thereby forming a gaseous phase, an aqueous phase and a solid residue, in step b), the organic matter being gasified in the presence of the beads 200, whereby the salts precipitate on the beads 200, forming a salt shell 210 covering the beads 200, the method further comprising the following steps of:

c) collecting the beads 200 covered by the salt shell 210 from the recoverable organic part (syngas), d) regenerating the beads 200 through the following sub-steps of:

d1) removing the salt shell 210 of the beads 200, for example by washing the beads 200 with an aqueous solution, the aqueous solution being at a temperature below 374° C., whereby the salts are dissolved, d2) heating the balls at a temperature between 600° C. and 1,000° C., preferably between 900° C. and 1,000° C.

e) preferably carrying out a second gasification step (total gasification) to gasify the organic matter not gasified in step b).

'Biomass' is understood to mean any inhomogeneous material of biological origin, which can be quasi-dry, such as sawmill residues or straw, or saturated with water, such as household waste.

Advantageously, the biomass has a moisture content of over 50%.

This can be algae (for example microalgae or macroalgae), agricultural waste (oil cake, branchwood waste, etc.), industrial waste (in particular from the paper industry), household waste, sludge from wastewater treatment plants, or wastewater.

Biomass refers hereafter to any type of natural, industrial or household waste containing a recoverable organic part and an inorganic part. In particular, it can be black liquor.

The biomass contains a substantial amount of inorganic matter, typically between 1 and 10% by mass. 'Between X and Y' is understood in this case and hereafter to mean inclusive of the bounds.

The inorganic part of the biomass can be formed of sodium carbonate salts and/or calcium carbonate salts and/or potassium carbonate salts.

The biomass can also have a low sulphur or nitrogen content, for example 1-5% by mass.

The different steps of these various alternative embodiments will now be described in more detail.

Prior to step a), some matters can be pre-treated and/or finely ground to avoid clogging upstream of the reactor.

Preferably, the biomass is ground before step a).

The feedstock mixture can be preheated to a temperature from 150° C. to 300° C., before step a).

In step a), the beads 200 are brought into contact with a stream of matter containing water and the biomass.

The stream of matter comprises the biomass and water. For example, the stream of matter comprises 10-20% biomass.

The stream of matter can be injected under pressure. It is advantageously injected under pressure and at a temperature between 150 and 300° C., preferably between 200° C. and 300° C.

The stream of matter is injected, for example, by means of a piston injection.

The beads 200 are at a temperature between 600° C. and 1,000° C., preferably between 700° C. and 1,000° C. and even more preferably between 900° C. and 1,000° C.

The biomass introduced into the reactor 100 is at a temperature between, for example, 10° C. and 300° C., preferably between 20° C. and 250° C. The biomass can be, for example, preheated to a temperature between 150° C. and 300° C., for example between 150° C. and 250° C. The temperature of the biomass is below the critical temperature (i.e. below 374° C.).

Advantageously, the main reactor 100 where the contact between the beads 200 and the biomass takes place is pressurised. In particular, it is at a pressure of above 222 bar and preferably above 250 bar. Thus, when the biomass comes into contact with the hot beads 200, the beads 200 provide the energy required by the biomass for the conditions to become supercritical. The salts in contact with the hot surface of the beads precipitate and coat these beads, thus forming a shell around the beads. The salt shell can be continuous or discontinuous.

The salts can begin to deposit on the beads 200 in step a).

The salts are, for example, sodium carbonate and/or calcium carbonate and/or potassium carbonate salts.

Carbon and/or carbonaceous matter can also be trapped together with the salts on the beads. Step d2) allows them to be recovered.

The beads 200 can be made of steel, metal alloy, ceramic (for example alumina or SiC) or glass.

In particular, an alloy resistant to corrosion and high temperatures is chosen.

The beads 200 can comprise a coating, for example made of ceramic or a catalytic material such as ruthenium. The coating can be continuous or discontinuous. When the biomass has a low sulphur or nitrogen content, beads without a catalytic coating are advantageously chosen in order to avoid poisoning.

Preferably, for continuous operation, metal beads (in particular beads made of steel or a metal alloy) are chosen.

The diameter of the beads 200 is, for example, between 500 μm and 2 mm, and preferably between 700 μm and 1 mm. The dimensions of the beads 200 depend in particular on the device used and in particular on the size of the pipes and valves as well as the filters for example used in step d). Beads with a satisfactory specific surface area are advantageously chosen.

During step a) or after step a), ethanol can be injected to dissolve the oils present in the reactor. Ethanol can dissolve the carbonaceous matter and in particular the oil (tar), which can be deposited on the surface of the beads and prevent the deposition of the salts. Advantageously, the use of ethanol also prevents the beads from adhering to one another. A fraction of the ethanol can also decompose into hydrogen and methane, improving the conversion of the matter.

Ethanol can be introduced into the reactor with the stream of matter. Ethanol can be added at a low concentration, for example 5 to 10% of the initial stream of matter. According to another alternative embodiment, ethanol is added directly into the salt separator.

In step b), the matter is subjected to a first gasification step in a supercritical medium. This is a partial gasification step.

The gasification reaction can take place with or without a catalyst.

Once the Gasification Reaction is Complete, the Following is Obtained:

- a gaseous phase comprising incondensable gases containing, inter alia, carbon monoxide (CO), carbon dioxide ($CO_2$), dihydrogen ($H_2$), and methane ($CH_4$),
- a solid phase: solid carbonaceous residues that are grouped together into the categories "char", "biochar", and
- an aqueous phase.

Trace amounts of bio-oils can also be obtained under supercritical conditions up to 400° C.

In step c), the carbonaceous matter is collected (i.e. the carbonaceous matter is separated from the salts). This step is carried out at a temperature above 374° C. so as not to dissolve the salts. Preferably, it is carried out at a temperature between 374° C. and 400° C.

Several Alternative Embodiments can be Implemented:

- the biomass can be gasified in the main reactor 100 used in step a) and the beads 200 covered with salts 210 are removed from the reactor 100 and/or the carbonaceous matter is discharged from the main reactor 100; for example, the beads 200 are extracted from the reactor 100 through an airlock positioned in the bottom part of the reactor, or
- the biomass is gasified in a gasification reactor 300 in the presence of the beads 200, then the beads 200 covered with salts 210 are removed from the gasification reactor 300 and/or the carbonaceous matter is discharged from the gasification reactor 300; for example, the beads 200 are extracted from the reactor 300 through an airlock positioned in the bottom part of the reactor 300.

The beads 200 act as a carrier for the salts. This facilitates their discharge from the reactor.

Then, in step d), the beads are regenerated. The beads are washed with an aqueous solution. Advantageously, they are washed with the aqueous phase from step b). The aqueous phase can be used as is or diluted. In step d), the salts are collected by dissolution in the liquid phase.

Washing is advantageously carried out with mechanical stirring and/or a vibrating device and/or in the presence of ultrasounds.

The temperature in step d) is, for example, between 30° and 320° C., which optimises the method's efficiency.

This cleaning phase lasts, for example, about 15 to 20 minutes in batch configuration. For continuous operation, dwell times of a few seconds to a few minutes can be chosen, for example from 10 seconds to 5 minutes, and preferably from 30 seconds to 2 minutes.

The aqueous phase containing the salts is discharged and filtered. The pores of the filter are preferably small enough to prevent losing the chars containing the recoverable carbon.

Step d) can be carried out at each cycle or after several cycles. The frequency of step d) depends on the quantity of salts collected from the surface of the beads.

The aqueous, gaseous and solid phases are separated. Separation preferably takes place at a lower temperature. The aqueous phase and the solid residues are used, for example, to regenerate the beads 200 (step d)). The aqueous phase can be diluted with mains water if the volume of the aqueous phase is not sufficient to clean the beads.

Advantageously, the method comprises a step in which the beads are subjected to a combustion step. This step removes the residual carbon ('char') deposited on their surface in step a) and/or b).

The step of combusting the residual char deposited on the beads 200 can take place in the main reactor 100 used in step a). If the beads have been extracted from this reactor 100, for example in step c), they can be reintroduced into the reactor 100 by means of a conveying device (for example a piston).

Figure 4:
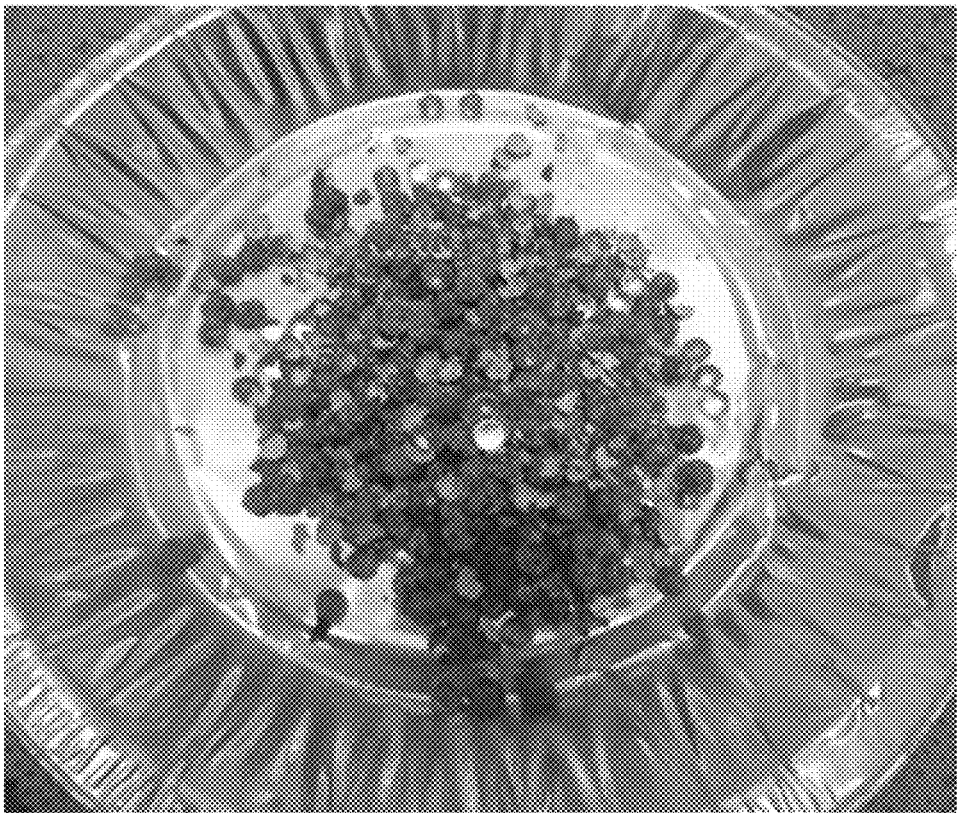
FIG. 4 is a photographic image of glass beads after being brought into contact with black liquor, being heated to 420° C. and cooled, according to one specific embodiment of the invention.

Preferably, combustion takes place in a heating reactor 800 positioned upstream of the main reactor 100 and allowing the beads 200 to be heated before being introduced into the main reactor 100 (FIG. 4). Combustion is advantageously carried out at a temperature between 700° C. and 1,000° C. and preferably between 900° C. and 1,000° C. It is advantageously carried out at atmospheric pressure (1 bar).

Other carbonaceous matters derived from the same method can be added. This can include, for example, carbonaceous matter from the paper industry: tree bark and other wood-derived compounds.

The residual solid with the salt has been measured, by calorimetry, to have a calorific value of 15 MJ/kg for the gasification of black liquor at 600° C. If the salt is extracted, the solid contains an energy of more than 30 MJ/kg (Dulong). This can be enough to provide the energy for combustion.

This step advantageously allows the beads to be preheated in order to carry out a new cycle.

This cycle of steps is advantageously repeated several times until the desired amount of gas is obtained.

After the salt separation method, the biomass gasification process can be completed (step e):

- either at a low temperature (typically at a temperature below 500° C.) in the presence of a catalyst: this is a catalytic gasification reaction,
- or at a high temperature (typically at a temperature between 600 and 700° C.); this embodiment is advantageous if the biomass contains sulphur.

Although this is by no means limiting, the invention particularly has applications in the paper industry and in particular for the recovery of black liquor.

The device for implementing the method in a closed loop will now be described in more detail.

The device comprises the following elements positioned successively in series (FIGS. 1 and 2):

- a main reactor 100 (also referred to as a pre-gasification reactor),
- a gasification reactor 300,
- a bead collection chamber 500 (also referred to as a separation chamber).
- a heating reactor 800 connected to the main reactor 100.

The Device Comprises at Least Two Inlets and at Least One Outlet:

- a feedstock inlet 101 disposed at the main reactor 100,
- a brine outlet 603 disposed between the collection chamber 500 and the heating reactor 800, for discharging the brine,
- a water/gas mixture outlet 502 disposed at the collection chamber 500 for discharging a mixture of supercritical water and syngas, the water/gas mixture outlet 502 advantageously being connected to another gasification reactor (not shown) for completing the biomass gasification process.

For a device that operates continuously, the beads 200 are continuously circulated through the various components of the device. For example, some of the beads 200 are in the main reactor 100 while others are in the gasification reactor 300 and other beads 200 are in the collection chamber 500.

This alternative embodiment allows the device to operate continuously. It allows for a dedicated bead heating unit that may or may not involve combustion, a dedicated gasification unit and a dedicated bead washing unit. This avoids subjecting the combustion reactor to numerous pressure and temperature variations (heating and then washing). Such extreme variations in temperature and pressure can quickly put the reactor material to the test. A wider range of materials can be used. Moreover, the heat exchange taking place after combustion is simplified.

This Continuous Mode of Operation can Comprise the Following Cycle of Steps:

- implementing step a) in the main reactor 100, wherein step a) can lead to the start of gasification of the organic matter, as the beads can start to become covered with salts in this step,
- implementing step b) in the gasification reactor 300 (this is preferably a tube), in the presence of the beads 200 to procure the optimal dwell time,
- implementing step c) by feeding the beads 200 into the collection chamber 500,
- then, after completing one or more cycles, the following steps are implemented:
- implementing step d1) in the collection chamber 500, and preferably in a salt dissolution chamber 600 (this is preferably a tube), in order to procure the optimum dwell time,
- implementing step d2) in the heating reactor 800 positioned upstream of the main reactor 100,
- preferably implementing step e) in a further gasification reactor connected to the outlet 502 of the collection chamber 500.

The arrangement of the various components of the device will now be described in more detail.

The main reactor or pre-gasification reactor 100 comprises the feedstock inlet 101, a bead inlet 102 and an outlet 103 for discharging a reaction medium comprising the beads, water and biomass.

The biomass can be stored in a storage reactor. A transfer system comprising a transfer airlock can be disposed between the storage reactor and the main reactor or pre-gasification reactor 100 to transfer the biomass from the storage reactor to the main reactor 100.

The bead inlet 102 is also connected to the heating reactor 800.

The heated beads 200 are brought into contact with the feedstock mixture in the main reactor or pre-gasification reactor 100. The reactor can be:

- at a high pressure (typically above 250 bar) and at ambient temperature (between 2° and 25° C.), or
- at a high pressure (typically above 222 bar and preferably above 250 bar) and at a temperature above 200° C. and preferably below 374° C. (for example 300° C.).

The beads 200 transfer their heat to the feedstock mixture: the temperature of the mixture rises to supercritical conditions (temperature above 374° C.). A reaction mixture is formed in the main reactor or pre-gasification reactor 100.

The reaction mixture is then fed into the gasification reactor 300 connected to the outlet 103. This reactor is, for example, a tube. It is of a suitable length to allow the energy stored in the beads to be transferred to the supercritical water and the salts to be deposited on the beads 200 as the water passes into the gas phase.

At the outlet 302 of the gasification reactor 300, the reaction mixture is discharged into a collection chamber 500. In this chamber 500, a mixture of gas and supercritical water is separated from the beads 200 covered by the salt shell 210. The bottom part of the chamber 500 is regulated to a temperature below the critical temperature of 374° C.

(for example to a temperature of 360° C.) so that the supercritical gas becomes liquid again and the salts are thus re-dissolved in the water. An outlet 502 allows the supercritical water and syngas to be discharged. An outlet 503 allows the beads to be discharged.

To enhance the dissolution of the salts, the beads 200 can be passed through a dissolution chamber 600, advantageously in the form of a tube, filled with water, for example under gravity, over a suitable length. The tube comprises a first end connected to the outlet 503 of the separation chamber 500. At the other end of the tube 600, the brine outlet 603 allows the salt-filled liquid to be discharged. The output flow rate is advantageously equivalent to the input flow rate.

The temperature of the tube 600 is below 374° C. so as to dissolve the salts. Preferably, it has a temperature above 300° C. to avoid cooling the solution too much and subsequently minimising the energy input when heating the beads 200.

The tube 600 feeds beads 200 to a preheating reactor 700 via the outlet 602. This reactor 700 is advantageously provided with an Archimedes screw to convey the beads 200 from the bottom to the top of the reactor 700. During the bead conveying phase, the reactor is heated (either electrically or by a hot gas produced by a burner) to allow the residual water to be brought to supercritical conditions and the energy to be stored in the beads, which are then freed of the salts.

The reactor 700 can be provided with a dioxygen inlet 701. Advantageously, the use of dioxygen allows the residual carbon deposited on the beads 200 to be burnt.

A heating reactor 800, for example a spiral heat exchanger, is disposed between the preheating reactor 700 and the main reactor 100 to complete this operation of heating the beads 200. The reactor 800 has an optimised extended length allowing the beads 200 to be brought to a temperature suitable for the desired test conditions (typically between 700° C. and 1,000° C., preferably between 900° C. and 1,000° C.) for example by means of hot flue gases generated by a burner.

The beads superheated in this manner are fed into the main reactor 100 via the inlet 102 under gravity for a new cycle.

Figure 3:
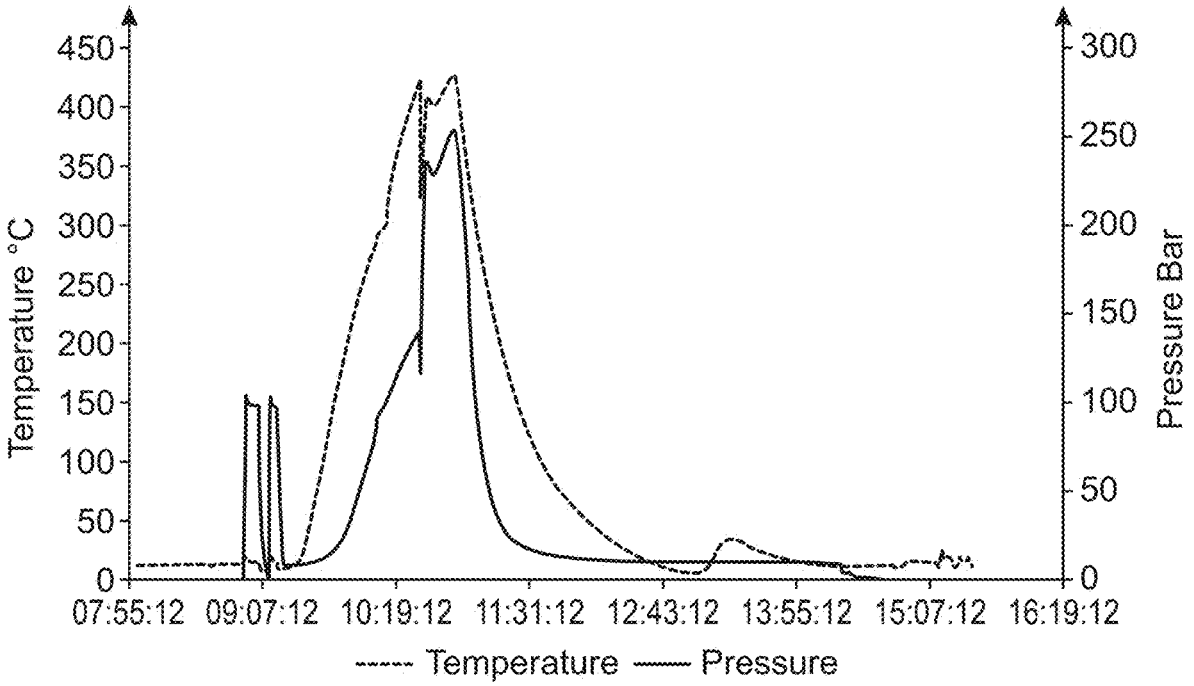
FIG. 3 is a graph showing temperature and pressure profiles as a function of time for a reactor containing glass beads and black liquor, according to one specific embodiment of the invention.

Illustrative and Non-Limiting Example of One Embodiment with a Batch-Type Reactor In this example, a 500 ml batch reactor (TOP Industrie) was used. 90 g of glass beads were added into the batch reactor with 27 g of water and 3 g of ethanol. The beads are preheated to a temperature of at least 700° C. The reactor was heated to a temperature of 400 to 420° C. About 27 g of black liquor was injected. The pressure was about 250 bar. Once the temperature had reached 420° C. for 5 minutes, the reactor was cooled according to the heat treatment shown in the graph in FIG. 3. The gases formed were then analysed. The main elements formed at this temperature are nitrogen, carbon dioxide and small amounts of hydrogen.

Once cooled, the reactor was opened. The beads are separated from the aqueous phase. It was observed that the beads were coated with a fairly hard layer of salts and bonded to one another (FIG. 4). The salt layer can be collected, for example, by vigorously mixing the beads, thereby breaking up the salt layer, and/or by washing with an aqueous solution.

Illustrative and Non-Limiting Example of One Embodiment with a Reactor in Continuous Operation For illustration purposes only and without limiting the scope of the invention, the dimensioning of a gasification unit that can treat 100 kg/h of biomass in a continuous mode will now be given in more detail. Such a unit is, for example, shown in FIG. 2.

The boundary conditions are as follows: Tcold in the element 500=360° C., Tgas outlet (S1)=500° C., Tbrine (S2)=360° C.

The resource E is injected at the inlet 101. This is a biomass at 20% dry matter. The flow rate is 100 kg/h. The biomass is at ambient temperature Tamb=20° C.

The beads are made of stainless steel 304L with a diameter of 2 mm, Cp=500 J/kg° K, p=7,000 kg/m$^3$. There are about 34,000 beads.

When the beads are introduced into the reactor 100 via the bead inlet 102, they have a temperature of 790° C. The flow rate is 1000 kg/h. The power to be supplied and exchanged is 60 kW.

The reactor 100 allows the hot beads to be brought into contact with the biomass and mixed therewith. The reactor 100 is made of Inconel 600. The biomass inlet 101 can be perpendicular to the stream of beads or countercurrent to the stream of beads. The biomass inlet 101 has a diameter of 15 mm. It can be a vertical branch positioned at the top of the reactor 100. Preferably, this is a side branch.

The bead inlet 102 has a diameter of 17.1 mm and a thickness of 3.2 mm (tangential side branch).

Advantageously, the reactor 100 comprises a cylindrical part at the inlets 101 and 102 and a cone-shaped part at the outlet 103 to facilitate mixture discharge. The outlet cone has, for example, a height H=200 mm. The cylindrical part has, for example, a diameter D=100 mm and a height H=400 mm.

The outlet of the reactor 103 has, for example, a diameter of 20 mm. It is connected to the inlet of the gasification reactor 300.

The gasification reactor 300 is made of Inconel 600. The reactor 300 is preferably a 20×2.7 mm tube with a length of L=2,000 mm. It has, for example, an adjustable inclination (20 to 60°). It has an electrical power of Pelec=5 kW (compensation for thermal losses).

The outlet 302 of the gasification reactor 300 has, for example, a diameter of 20 mm.

The collection chamber 500 is a solid/gas separator made of Inconel 600. The gas outlet 502 for discharging the gases (S1) has, for example, a diameter of 15 mm.

The collection chamber 500 has, for example, the following dimensions: D=100 mm and H=400 mm. The bottom part of the chamber 500 is preferably cone-shaped to facilitate bead discharge. The outlet 503 has a diameter of 20 mm for example. The outlet cone has, for example, a height H=200 mm. The bottom of the chamber is at a temperature below 374° C. (for example 360° C.) so that the supercritical gas can become liquid again and so as to re-solubilise the salts.

The redissolution of the salts can be improved by using an additional component 600. This can be a 304L stainless steel tube for example, with a length of L=2,000 mm for example. The inclination is adjustable (10 to 45°).

The outlet 602 for transferring the beads to the preheating reactor 700 has a diameter of 20 mm for example. The brine outlet 603 (S2) has a diameter of 20 mm for example.

The Archimedes screw of the element 700 can be made of stainless steel 304L. It is, for example, a 20×2 mm tube with spiral crimped blades, of thickness=5 mm, pitch=20 mm, Dext screw=100 mm, Length=1,000 m. The motor of the Archimedes screw has, for example, a power of P=1 kw with a reduction gear, and a variable Speed from 0 to 10 rpm.

The heating reactor 700 is made of stainless steel 304L. Preferably, this is a tube of dimensions: 100×5 mm and L=1,100 mm. The inlet 801 of the heating reactor 800 is a side branch, for example, with a diameter of 20 mm. The outlet of the reactor 800 is a side branch, for example, with a diameter of 17.1 mm. It has a power Pelec of 20 kW. For example, heating cables wrapped around the reactor 800 are used. The reactor is preferably tubular. The heating coil is made of Inconel 625 with the following properties: Tube 17.1×3.2 mm, L=5,000 mm helically wound (D=320 mm). For example, 5 coils over H=800 mm and Pelec=40 kW (Kanthal type radiant heating zone) are chosen.

REFERENCES

[1] US 2010/0154305 A1
[2] US 2014/0054507 A1
[3] WO 2016/113685 A1
[4] US 2017/0218286 A1

The invention claimed is:

1. A method for gasifying biomass comprising the steps of:

a) in a main reactor, bringing beads that have been pre-heated to a temperature between 600° C. and 1,000° C. into contact with a feedstock mixture comprising water and a biomass, the biomass comprising an organic part and salts, wherein the beads are made of a material that is selected from steel, a metal alloy, glass or a ceramic, and wherein the main reactor is pressurised to more than 222 bar;

b) at least partially gasifying the organic part, in the presence of the beads at a temperature above 374° C. and at a pressure above 222 bar, thereby forming a gaseous phase, an aqueous phase and a solid residue, and whereby the salts precipitate on the beads, forming a salt shell covering the beads;

c) separating the beads covered by the salt shell from any recoverable organic part; and d) regenerating the beads.

2. The method according to claim 1, wherein in step a), the main reactor is heated to a temperature above 200° C. and below 374° C.

3. The method according to claim 1, wherein step d) comprises the following sub-steps:

d1) removing the salt shell of the beads; and d2) pre-heating the beads to a temperature between 600° C. and 1,000° C.

4. The method according to claim 3, wherein step d1) is carried out by washing the beads with an aqueous solution at a temperature below 374° C., whereby the salts are dissolved.

5. The method according to claim 3, wherein sub-step d2) is carried out in a heating reactor positioned between a collection chamber and the main reactor.

6. The method according to claim 3, wherein during sub-step d1), the beads are washed with the aqueous phase from step b).

7. The method according to claim 3, wherein the solid residue from step b) is used to pre-heat the beads to a temperature between 600° C. and 1,000° C. in sub-step d2).

8. The method according to claim 1, wherein the biomass has a moisture content of over 50%, whereby the biomass can be ground prior to step a).

9. The method according to claim 8, wherein the biomass comprises microalgae, macroalgae, agricultural waste, household waste, sludge from wastewater treatment plants or wastewater.

10. The method according to claim 1, wherein the beads have a diameter of from 500 μm to 2 mm.

11. The method according to claim 1, wherein the method further comprises a step in which oils contained in the biomass are dissolved by injecting ethanol into the main reactor.

12. The method according to claim 1, wherein the method further comprises a subsequent step e) in which a further gasification step is carried out at a pressure above 222 bar in order to gasify the organic part not gasified in step b), the temperature in step e) being between 60° and 700° C. or step e) being carried out in the presence of a catalyst at a temperature below 500° C.

13. The method according to claim 1, wherein, in step b), the organic part is gasified in a gasification reactor.

14. The method according to claim 13, wherein the gasification reactor is in fluid communication with a collection chamber and in that, in step c), the beads are collected in the collection chamber.

15. The method according to claim 1, wherein the feedstock mixture is preheated to a temperature from 150° C. to 250° C., before step a).

* * * * *